United States Patent [19]

Cawley

[11] 4,017,118

[45] Apr. 12, 1977

[54] PATIENT SUPPORTING DEVICE

[76] Inventor: Reginald E. Cawley, 12826 Chapman Ave., Apt. B, Garden Grove, Calif. 92640

[22] Filed: Apr. 19, 1976

[21] Appl. No.: 678,296

[52] U.S. Cl. ..... 297/284; 5/338; 5/369; 297/75; 297/391; 297/410; 297/417

[51] Int. Cl.[2] ..... A47C 3/00

[58] Field of Search ..... 5/338, 369; 297/75, 297/284, 391, 410, 417

[56] References Cited

UNITED STATES PATENTS

| | | | |
|---|---|---|---|
| 3,192,541 | 7/1965 | Moore | 297/284 X |
| 3,326,601 | 6/1967 | Vanderbilt et al. | 297/284 |
| 3,330,598 | 7/1967 | Whiteside | 297/284 |
| 3,363,941 | 1/1968 | Wierwille | 297/284 |
| 3,608,961 | 9/1971 | Von Heck | 297/284 |
| 3,795,021 | 3/1974 | Moniot | 297/284 X |
| 3,895,403 | 7/1975 | Davis | 297/284 X |
| 3,934,929 | 1/1976 | Rabinowitz | 297/75 |

FOREIGN PATENTS OR APPLICATIONS

| | | | |
|---|---|---|---|
| 2,222,532 | 11/1973 | Germany | 297/284 |

*Primary Examiner*—James C. Mitchell
*Attorney, Agent, or Firm*—Gausewitz, Carr & Rothenberg

[57] ABSTRACT

This invention provides a patient supporting device, such as a dental chair, that includes a stationary seat portion with movable backrest and toeboard portions, the chair being provided with a plurality of bladders to vary its contour. This includes bladders on the toeboard selectively inflatable to provide the effect of a deeper seat for the chair. Selectively inflatable bladders on the seat can simulate tilting of the seat when the back is lowered. Spaced bladders on the back support the lumbar region and the shoulders of the patient, and a third bladder on the back supports the patient's spine. Four bladders beneath pads are in the headrest, used in tilting the patient's head. An adustable edge portion for the back supports the patient's arms when in a supine position.

26 Claims, 10 Drawing Figures

10
11
12
13
14
22
25
27
28
29
30
31
32
33
34
35
37
38
39
40
41
42
43
44
45
47
48
56
57
60
68
69
70
71
79
82
83

9-1
9-1

FIG. 9.
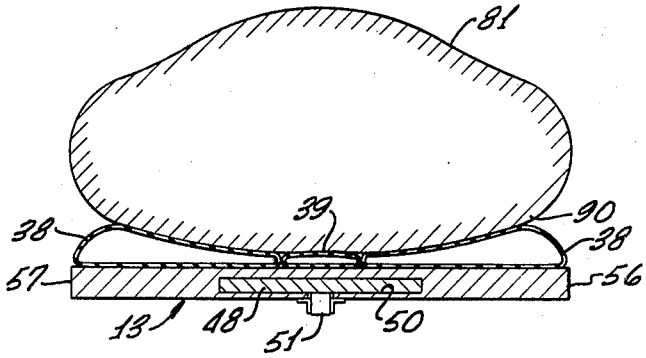
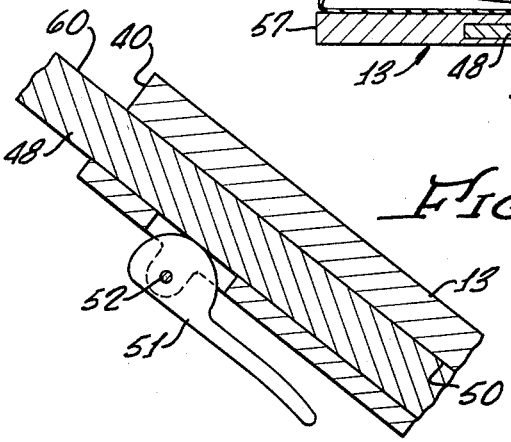
FIG. 4.
FIG. 10.
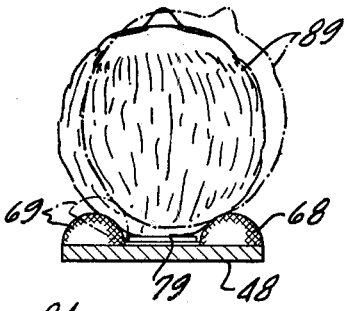
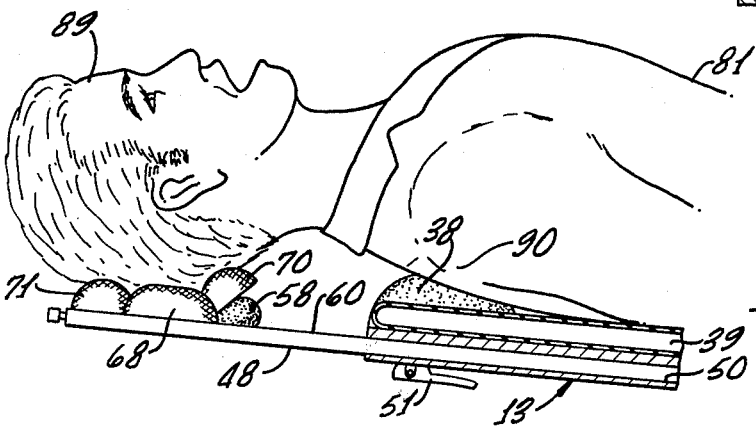
FIG. 8.
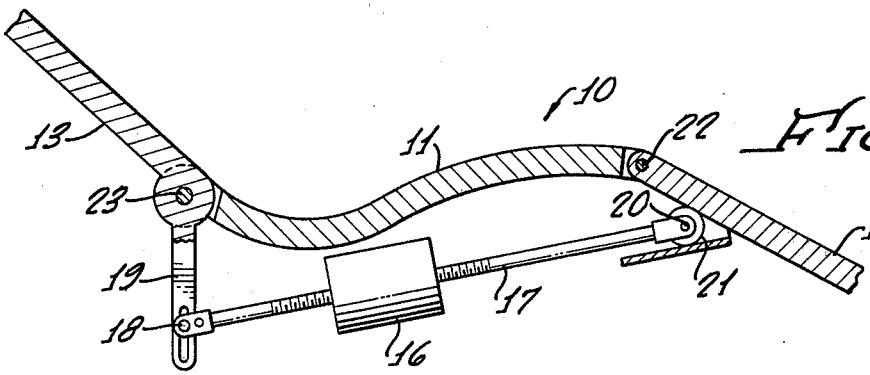
FIG. 3.

PATIENT SUPPORTING DEVICE

BACKGROUND OF THE INVENTION

1. Field of the Invention

This invention relates to a patient supporting device such as a dental chair.

2. Description of the Prior Art

Previously existing dental chairs have a number of shortcomings which can result in patient discomfort, inconvenience for the patient, as well as inefficiency and fatigue for the dentist. For one thing, the dental chair is of fixed dimension and so it cannot properly accommodate patients of different-sized skeletal frames. A short patient will not fit the chair the same way as a taller patient. The chair cannot comfortably accommodate both. Also, the common dental chair does not have any means for articulating the head so that the oral cavity is conveniently located for the dentist. Support for various parts of the patient's anatomy is lacking as the chair is adjusted in causing the patient to recline or sit up more straight as circumstances demand. Conventional dental chairs also may be difficult for a patient to get into and out of.

Inflatable bladders have been used in conjunction with some chairs and beds as a means for supporting or manipulating a person's anatomy, but have not dealt with the problems noted above. In U.S. Pat. No. 3,795,021, a headrest is provided in which four bladders are engaged by the patient's head and can be selectively inflated to tilt the head to a desired position. However, the device of this patent provides no pads for supporting the head, and discloses a rather elaborate overlapping arrangement of bladders for obtaining maximum movement. U.S. Pat. No. 3,895,403 provides bladder means for use in a hospital bed for turning a patient, but is not adapted for a dental chair which requires no such patient movement. Other designs are shown in U.S. Pat. Nos. 3,192,541, 3,326,601, 3,330,598, and 3,608,961, but these are for providing more comfort in conventional seats rather than being adapted to solve the problem of a dental chair discussed above.

SUMMARY OF THE INVENTION

The present invention provides an improved dental chair which overcomes the difficulties of the prior art, effectively supporting the patient in comfort while allowing the dentist to work more easily and with greater efficiency. The chair includes a seat portion from which extends a backrest and toeboard. The latter elements are adjustable relative to the seat portion, as the toeboard can be raised as the backrest is lowered.

The toeboard includes inflatable bladders adjacent the seat which can be selectively inflated to provide the effect of an extension of the seat. This allows the chair to accommodate taller patients in comfort, as well as those who are relatively short. The back includes a transverse bladder at its lower portion which when inflated supports the patient's lumbar region. There is also an elongated central bladder, longitudinal of the seat back, that supports the spine. At the top of the back is an additional transverse bladder which is positioned beneath the shoulder area of the patient. This can be used in controlling the position of the patient's head as inflation of this portion of the backrest will cause the head to tilt back so that the chin is raised.

The headrest of the device is adjustable relative to the backrest, and includes means to articulate the position of the head. It includes a central pad around which are four additional pads connected to the backrest by hinges. Beneath the four additional pads are four bladders, selectively inflatable to cause these pads to pivot upwardly as desired. The patient's head engages the central pad and is received within the space bordered by four additional pads. Appropriate inflation of the bladders of the headrest can cause the head to be tilted upwardly and downwardly, or to be tilted from side to side. The use of the pads over the bladders with their hinged connections provides for a particularly large amount of movement of the patient's head as the bladders are inflated.

The toeboard includes an additional bladder at its distal end portion which can be inflated when the patient is in a supine position and it is desired to raise the patient's feet.

The arms of the chair are pivotal upwardly to allow the patient to enter and leave the chair without obstruction. There are, in addition, side edge members along the backrest which are pivotal outwardly to form supports for the patient's arms when the backrest is in the lowered position.

By these features, the present invention provides a dental chair that will effectively accommodate persons of different shapes and sizes. The patient's head is articulated readily to locate the oral cavity where it is most convenient for access by the dentist. This will allow the dentist to operate from a seated position with the patient supine. The chair may be positioned quite low to the floor, again enhancing the comfort and convenience of the dentist. This results from the thin profile presented by the chair, with bladders inflatable to raise the surface of the chair only where needed. Conventional thick-padded upholstery is not used. In addition, patient ingress and egress is accomplished easily.

BRIEF DESCRIPTION OF THE DRAWINGS

FIG. 3 is a schematic side elevational view of the chair, showing the means for moving the backrest and toeboard;

FIG. 4 is a fragmentary sectional view illustrating the arrangement for adjusting the position of the headrest;

FIG. 8 is a fragmentary side elevational view illustrating manipulation of the patient through inflation of bladders on the backrest and headrest;

FIG. 9 is a transverse sectional view, taken along line 9—9 of FIG. 2; and

FIG. 10 is an end elevational view of the headrest, illustrating how a patient's head may be rotated.

DESCRIPTION OF THE PREFERRED EMBODIMENT

Figures 1, 6:
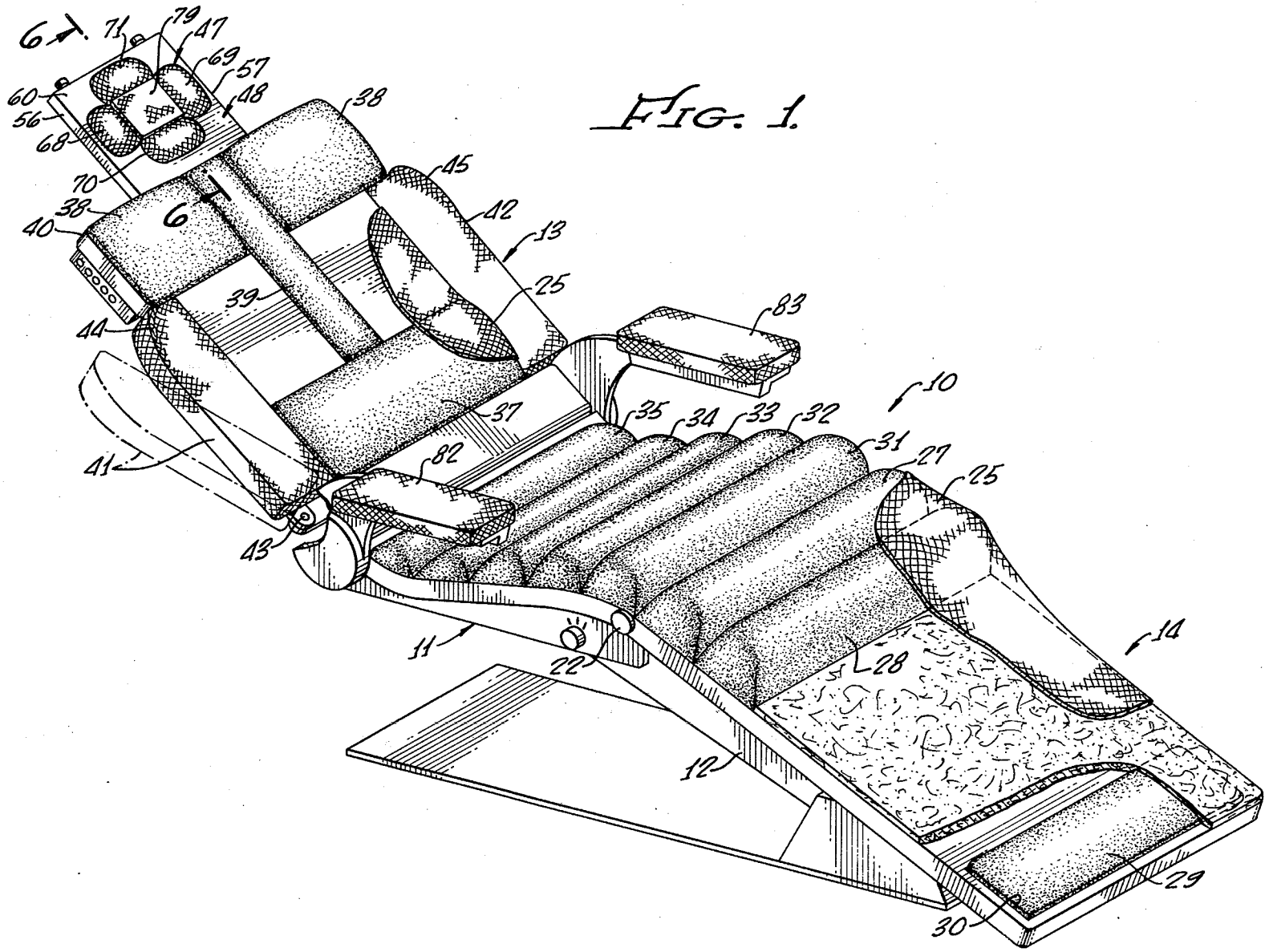
FIG. 1 is a perspective view of a dental chair constructed in accordance with the present invention.
FIG. 6 is a fragmentary longitudinal sectional view, taken along line 6—6 of FIG. 1, showing the components of the headrest.

The dental chair 10, illustrated in the drawing, includes a fixed seat portion 11 supported on a pedestal 12. A back 13 inclines upwardly from one end of the seat portion and a toeboard 14 inclines downwardly from the other. The back 13 and toeboard 14 are pivotal relative to the seat 11, which may be accomplished by a conventional arrangement such as that shown in FIG. 3. A drive unit 16 is operable to cause rectilinear movement of a shaft 17 that extends outwardly in either direction from the drive unit. One end of the shaft 17, through a pivot pin 18, connects to an arm 19 that is attached to the seat back 13. The other end of the shaft 17, through a shaft 20, carries a wheel 21 that is adjacent the underside of the toeboard 14. If the drive unit 16 moves the shaft 17 linearly to the right, as illustrated in FIG. 3, it will cause the wheel 21 to move outwardly against the toeboard 14, pushing upwardly on the toeboard. This will cause the toeboard to pivot about a transverse shaft 22 by which it connects to the fixed seat 11. This movement of the shaft 17 also will cause the arm 19 to pull downwardly on the seat back 13 above the shaft 23 that connects the seat back to the opposite end of the seat portion 11 of the chair. Thus, as the toeboard goes up, the seat back goes down. Reverse movement of the shaft 17, of course, causes the opposite effect.

On its upper side, the chair 10 includes a series of bladders beneath its outer surface of upholstery 25. The bladders are adapted to be selectively inflated to enable the chair 10 to accommodate patients of different sizes of skeletal frames and to achieve control of the patient's position for maximum efficiency and comfort in performing treatment for the patient. The various bladders are shown inflated in FIG. 1 to clarify their shapes and positions, but ordinarily are inflated on a selective basis when the chair is in use.

On the toeboard 14 there are two bladders 27 and 28 adjacent the upper end of the toeboard where it connects to the seat 11. The bladders 27 and 28 are transverse relative to the toeboard 14, each being elongated and extending substantially the full width of the toeboard. The bladders 27 and 28 are next to each other, and when inflated present rounded exterior surfaces. An additional transverse bladder 29 is received in a recess 30 adjacent the bottom end of the toeboard, spaced from the bladders 27 and 28. The bladder 29 extends laterally from one side of the toeboard to the other and is wider than either the bladder 27 or the bladder 28. In other words, the bladder 29 has a relatively large dimension longitudinally of the toeboard 14.

The entire upper surface of the seat 11 is occupied by a series of transverse bladders that extend from one side of the seat to the other. These are the bladders 31, 32, 33, 34, and 35, in sequence from the end of the seat 11 adjacent the toeboard 14 to the opposite end of the seat adjacent the connection to the back 13. These bladders range in size progressively from a relatively large bladder 31 to a smaller bladder 35. The bladder 31 is immediately adjacent the upper bladder 27 of the toeboard 14.

The backrest 13 includes transverse bladders 37 and 38 at its lower and upper ends, respectively. These bladders are relatively wide so that they occupy substantial area of the backrest 13, but they are spaced apart. The upper bladder 38 is split centrally, being in two sections at the upper corners of the backrest 13. Between the two sections of the upper bladder 38 is an elongated bladder 39 that extends longitudinally from the upper end 40 of the backrest to the upper edge of the lower bladder 37 of the backrest.

Along the side edges of the backrest 13, below the upper bladder 38, are elongated supports 41 and 42 which are pivotally connected to the seat back at their lower ends for transverse rotational movement outwardly. The support member 41 is connected by a pin 43 to the seat back, as shown in FIG. 1, while the connection for the support member 42 is similar. The connection is constructed to permit the support members 41 and 42 to pivot laterally outwardly a limited distance, typically 20°, as indicated in phantom. In this position they are used as arm supports when the seat back is lowered and the patient is supine. Raised lips 44 and 45 at the upper ends of the support members 41 and 42 help confine the patient's elbows when these members are pivoted outwardly. When the seat back is up, as in FIG. 1, the members 41 and 42 are positioned inwardly and merely serve as the side edge portions of the backrest.

The headrest 47 of the chair 10 is mounted on a support 48 which is an elongated rigid rectangular sheet at the center of the backrest 13, projecting outwardly beyond the upper edge 40 of the backrest. The support 48 fits within a complementary longitudinal slot 50 extending inwardly of the backrest 13 from the upper edge 40. The amount of the support 48 extending beyond the upper edge 40 is adjustable by sliding the support 48 longitudinally relative to the backrest and locking it in a desired location by a lever-actuated cam locking member 51 (see FIG. 4). The latter element is pivotal about a pin 52 on the backrest 13 and rotatable to position the lobe of the cam against the surface of the support 48 to lock the latter element in position.

Figure 5:
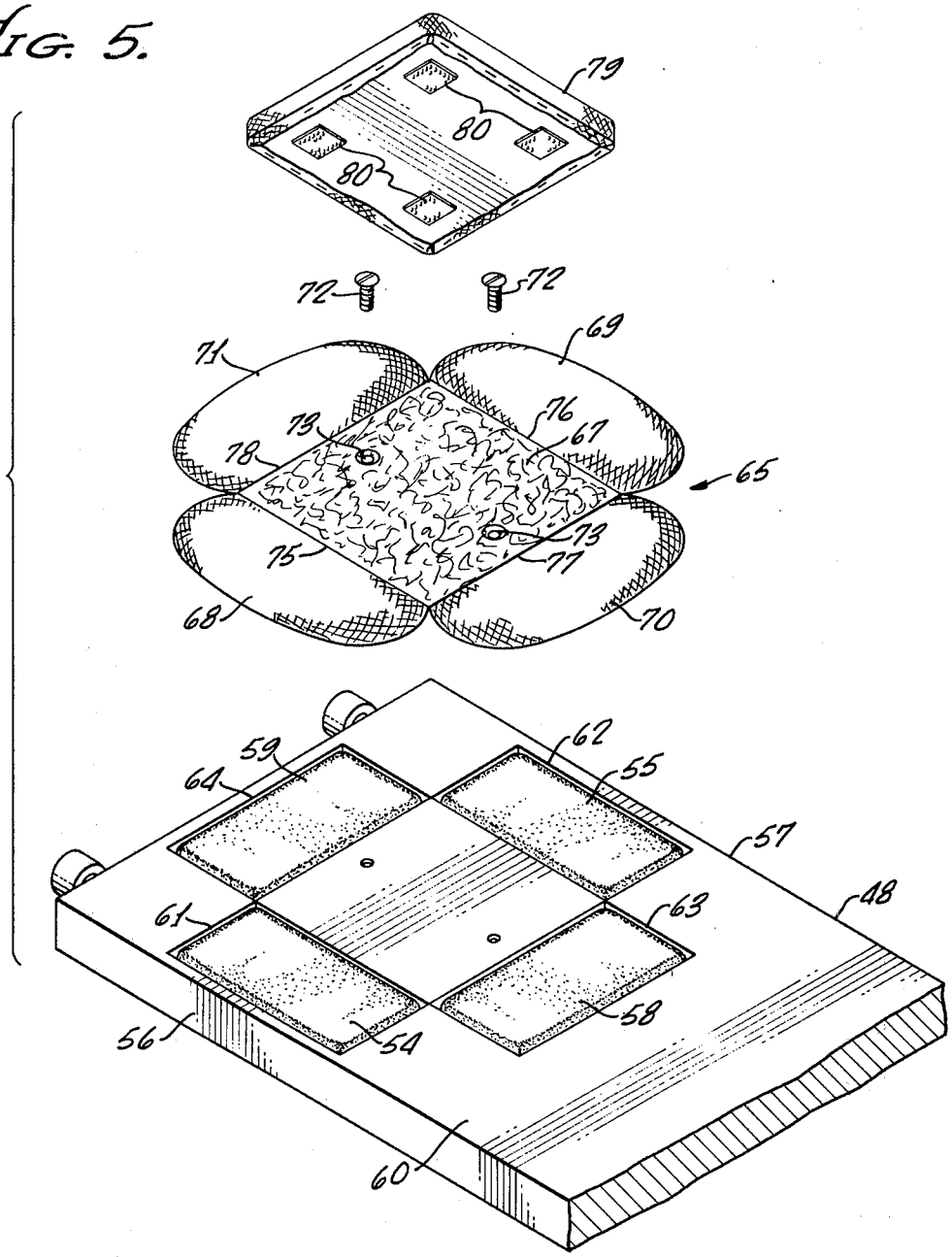
FIG. 5 is an exploded perspective view of various components of the headrest.
Figure 6:
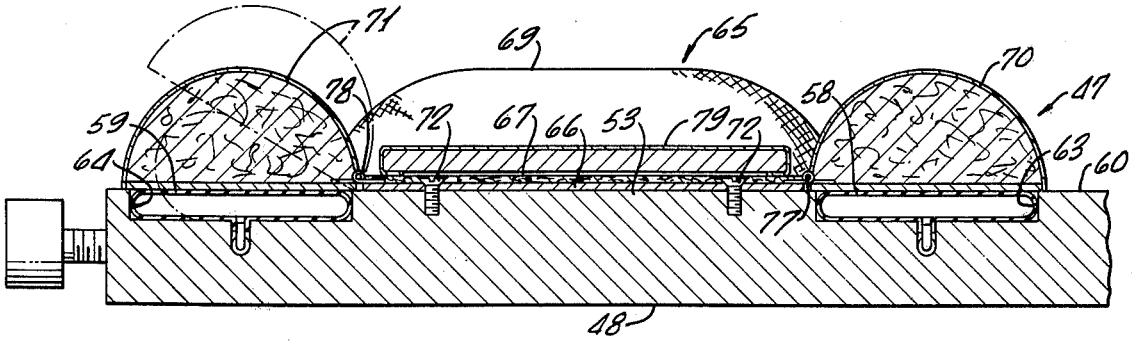

The headrest 47, shown in exploded perspective in FIG. 5 and in section in FIG. 6, includes four bladders of generally rectangular shape arranged with their corners in adjacency so that their inner edges define a square space 53. This includes bladders 54 and 55 adjacent the side edges 56 and 57 of the support 48, which have their longitudinal axes parallel to the longitudinal axis of the support 48. The bottom and top bladders 58 and 59, respectively, of the headrest 47 have their longitudinal axes transverse to the longitudinal axis of the support 48. The bladders 54, 55, 58, and 59 fit within recesses in the support 48 so that they do not extend appreciably above the upper surface 60 of the support when deflated. Recesses 61 and 62 accommodate the side bladders 54 and 55, the other bladders 58 and 59 being received in recesses 63 and 64.

A pad assembly 65 fits over the bladders 54, 55, 58, and 59, as well as the square area 53 within the inner edges of the bladders. The assembly 65 includes a thin flat central plate 66 over which is attached a pile fabric 67 having looped fibers. The plate 66 and fabric 67 are square and of substantially the same dimensions of that of the area 53. Four pads 68, 69, 70, and 71 are positioned around the periphery of the center plate 66. These pads are upholstered and relatively firm. They have flat undersurfaces, but their outer surfaces are curved and extend above the level of the plate 66. The contours of the pads 68, 69, 70, and 71 are straight alongside the central plate 66 but rounded elsewhere. These pads cover slightly greater areas than the bladders 54, 55, 58, and 59 over which they fit in the assembled headrest.

Attachment of the assembly 65 to the support 48 is accomplished by a pair of screws 72 which extend through openings 73 in the fabric 67 and plate 66 to enter tapped holes 74 in the support 48. Hinges 75, 76, 77, and 78 connect the straight inner edges of the pads 68, 69, 70, and 71, respectively, to the center plate 66 so that the pads may be rotated upwardly about these connections.

A center pad 79 occupies the space within the pads 68, 69, 70, and 71 in the assembled headrest 47. The center pad 79 is square in plan view, relatively firm and upholstered on its upper surface. On the lower surface are patches 80 of hook fastening elements which become embedded in loops of the fabric 67 over the plate 66 to hold the pad 79 in place. Fastenings of this type are marketed under the trademark "Velcro." This forms a removable attachment for the pad 79.

When the patient 81 enters the chair 10, normally it is in the position of FIG. 1, with the toeboard 14 inclined downwardly from the forward end of the seat 11, and the back 13 raised, but also inclined. The side members 41 and 42 of the back are pivoted inwardly and adjacent the side edges of the seat back. The armrests 82 and 83 of the chair are connected at the pivot axis 23 of the seat back 13 and may rotate upwardly independently to facilitate entering the chair 10. One or the other of the armrests 82 or 83 will be raised so that the side portion of the seat 11 is unobstructed.

Figures 2, 7:
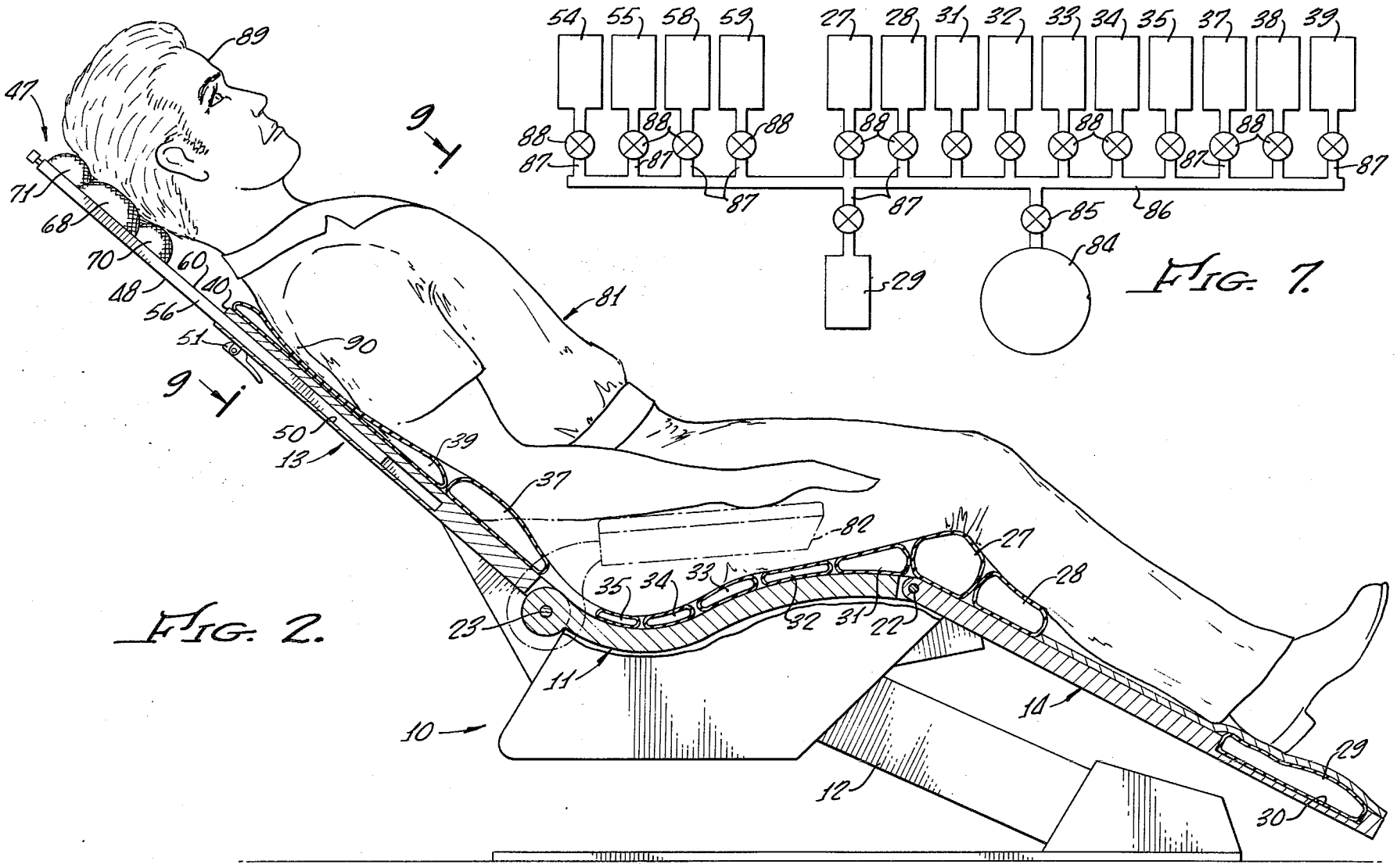
FIG. 2 is a side elevational view of the dental chair occupied by a patient.
FIG. 7 is a schematic view of the arrangement for inflating the various bladders associated with the chair.

Selected ones of the bladders of the chair may be inflated both prior to and during occupancy. Automatic controls may be built into the system to cause automatic inflation and deflation of various bladders upon certain occurrences. Thus, the control system may take a variety of forms in the completed chair. The essence of the control system, shown schematically in FIG. 7, includes a source of compressed air 84 connecting through a main valve 85 to a manifold 86 off of which is a series of side outlets 87, one for each of the bladders of the chair. A control valve 88 is in each of the outlets to control the flow of air through it. These valves which, in some instances, may be power-operated, have on, off and vent positions. This allows the bladder with which the valve is to be associated to be inflated to the desired degree by first opening the valve and then closing it to retain the pressure. In the vent position, the supply of compressed air is shut off and the bladder vents to atmosphere and is deflated.

It is possible, also, to utilize a closed system for bladder inflation.

Before the patient 81 enters the chair, normally the bladders 31, 32, and 33 of the seat 11 of the chair are deflated. The bladders 34 and 35 at the rearward end of the seat are pressurized to serve as cushioning for this portion of the seat. The pressurization of those bladders is not varied.

The bladders 27 and 28 of the toeboard are manipulated in accordance with the size of the skeletal frame of the patient to provide proper support at the knee so as to comfortably accommodate the patient. The chair is proportioned so that, if the patient is relatively short, his knees will come approximately at the pivot point 22 where the toeboard 14 connects to the stationary seat 11. Thus, his legs bend at the location where the toeboard 14 inclines away from the seat so that the chair has the right shape for his comfort.

A patient of medium size will not exactly fit the chair 10 with the bladders uninflated because his knees will extend just past the connection between the seat 11 and toeboard 14. For such patients, the effect of a longer seat portion is realized by inflating bladder 27 at the top of the toeboard. This bladder then acts as an extension of the seat, giving support to the patient's legs behind the knees and allowing the legs to incline downwardly from that point along the toeboard 14. Thus, the effective dimension of the chair is increased to take care of a patient of larger stature.

For one having a large skeletal frame, both the bladders 27 and 28 are inflated. The bladder 28 provides support for the patient behind the knees farther out on the toeboard, again extending the effective dimension of the seat so that the patient may sit in comfort.

With the patient in the seated position, the support 48 is adjusted longitudinally relative to the seat back 13 so as to put the headrest 47 behind the patient's head 89. The back of the head then rests on the center pad 79 of the headrest within the space bounded by the pads 68, 69, 70 and 71.

If the patient is to be placed in a supine position, the backrest 13 is lowered and the toeboard 14 is raised in the manner described above. As this is done, the bladders 31, 32 and 33 may be inflated in that sequence, which simulates tilting of the seat 11. Automatic controls may be included with the chair to accomplish this inflation of the bladders 31, 32 and 33 as the back is lowered.

At some point during the lowering of the back 13, such as when it is at an angle of 40° relative to the horizontal the bladders 37 and 39 may be inflated. The bladder 37 so inflated gives support to the lumbar region of the patient. The elongated bladder 39, extending lengthwise of the seat back 13, supports the patient's spine above the lumbar.

With the seat back 13 lowered and the patient supine, the edge members 41 and 42 of the seat back 13 are pivoted outwardly so as to form a comfortable support for the patient's arms.

The attitude of the patient's head then may be controlled by manipulation of the air bladders of the back and headrest. For example, to tilt the patient's chin upwardly, bladder 38 at the upper end of the backrest 13 is inflated (see FIGS. 8 and 9). This pushes upwardly on the patient's shoulders 90 while his head 89 remains supported on the pad 79, causing the head to pivot so that the chin is elevated. At this time, he bladder 58 also may be inflated which causes the pad 70 to be moved upwardly. The pad 70 rotates about its hinge 77 and is elevated so as to push against the occipital protuberances and give support to the patient's neck.

For opposite movement of the patient's head, tilting the chin downwardly, the upper backrest bladder 38 is collapsed as is the bladder 58 for the lower pad 70 of the headrest. The bladder 59 is inflated, pivoting the upper headrest pad 71 upwardly so that it forces the upper part of the head off of its original position. This causes the head to rotate downwardly, lowering the patient's chin.

Movement of the head from side to side is accomplished by appropriate inflation of the bladders 54 and 55 of the headrest, as indicated in FIG. 10. Inflating the bladder 54 elevates the pad 64, pushing up on the right-hand side of the patient's head. This rotates the head to the left. Movement to the other side is accomplished by inflation of the bladder 55, while the bladder 54 is deflated. The bladder 55, pushing the pad 69 outwardly, lifts up on the left-hand side of the head to move it over to the right.

Thus, the dentist easily can control the attitude of the patient's head exactly as is most desirable for what is being performed on the patient, without the necessity for any action on the patient's part. Time is saved, more efficient and constant positioning of the head is obtained, and the patient enjoys greater comfort.

The blader 29 at the outer end of the toeboard 14 is inflated when the feet are to be raised for a specific operative procedure or in an emergency when the operator determines the need for a full Trendelenberg position. Being relatively wide, at least a portion of the bladder 29 will be beneath the feet of the patient whether he is short or tall.

The bladders on the chair 10 may be inflated and deflated selectively in different ways at various positions of the backrest 13 and toeboard 14 to accomplish appropriate manipulation of the patient. Many combinations are possible.

The foregoing detailed description is to be clearly understood as given by way of illustration and example only, the spirit and scope of this invention being limited solely by the appended claims.

I claim:

1. A device for supporting a patient comprising
seat means,
backrest means having bottom, top and side edges,
inflatable means on said backrest means for varying the surface contour thereof, said inflatable means including,
a first bladder means adjacent said bottom edge of said backrest means,
a second bladder means spaced inwardly from said side edges of said backrest means and extending longitudinally of said backrest means substantially at the center thereof,
and means for selectively inflating said bladders of said inflatable means.

2. A device as recited in claim 1 in which said first bladder means is an elongated bladder extending substantially from one side edge to the other side edge of said backrest means.

3. A device as recited in claim 1 in which said second bladder means is an elongated bladder extending substantially from said first bladder means substantially to said upper edge of said backrest means.

4. A device as recited in claim 3 including a third bladder means spaced from said first bladder means and adjacent the upper edge of said backrest means.

5. A device as recited in claim 4 in which said third bladder means is bisected by said second bladder means so that said third bladder means includes a portion on either side of said second bladder means.

6. A device as recited in claim 1 including in addition
a headrest, said headrest including
a central pad for engagement by a patient's head, four additional pads positioned one adjacent the top edge,
the bottom edge and either side edge of said central pad,
a bladder beneath each of said additional pads,
and means for selectively and individually inflating each of said last-mentioned bladders for selectively and individually raising said additional pads.

7. A device as recited in claim 6 including
hinge means connecting each of said additional pads to said headrest adjacent said central pad,
whereby said additional pads pivot upwardly upon said inflation of said bladders beneath said additional pads.

8. A device as recited in claim 7 in which said headrest includes
a support member carrying said central pad, four additional pads and bladders beneath said additional pads,
means connecting said support member to said backrest for permitting said support member to move longitudinally of said backrest,
and selectively operable locking means for locking said support in various positions relative to said backrest means.

9. A device as recited in claim 1 in which
said backrest means includes means for permitting movement thereof between a lowered relatively horizontal position and an elevated position in which said backrest means is relatively more vertical than when in said lowered position, and including in addition
an edge member adjacent either side of said backrest means,
and means for connecting said edge members to said backrest means for permitting movement of said edge members outwardly relative to said sides of said backrest means for supporting the arms of an occupant of said device when backrest means is in said lowered position.

10. A device for supporting a patient comprising
seat means,
backrest means,
toeboard means connected to said seat means and extending therefrom at an angle relative thereto,
at least one inflatable means on said toeboard means adjacent said seat means,
and means for selectively inflating said inflatable means for providing a protuberance on said toeboard means to act as an extension of said seat means.

11. A device as recited in claim 10 in which said inflatable means is an elongated bladder extending substantially from one side edge of said toeboard means to the other side edge thereof.

12. A device as recited in claim 11 including in addition
a second bladder on said toeboard means adjacent said first-mentioned bladder and on the side thereof remote from said seat means,
and means for selectively inflating said second bladder independently of said inflation of said first-mentioned bladder.

13. A device as recited in claim 12 in which
said toeboard means includes a distal end remote from said seat means,
and including a third bladder on said toeboard means adjacent said distal end,
said third bladder being spaced from said second bladder,
and means for selectively inflating said third bladder independently of said inflation of said first-mentioned bladder and said second bladder.

14. A device as recited in claim 13 in which said third bladder has a greater dimension longitudinally of said toeboard means than does either said first-mentioned bladder or said second bladder.

15. A device as recited in claim 1 including in addition a plurality of transverse bladders on said seat means, and means for selectively inflating said transverse bladders on said seat means.

16. A device as recited in claim 1 in which said backrest means includes means for permitting movement thereof between a lowered relatively horizontal position and an elevated relatively more vertical position, and including a plurality of transverse bladders on said seat means, and means for selectively inflating said transverse bladders on said seat means so as to allow the same to be inflated in sequence from the edge of said seat means remote from said backrest means to a location inwardly thereof when said backrest means is moved from said elevated position toward said lowered position.

17. A device for supporting a patient comprising seat means, and support means extending from said seat means for providing a backrest and a headrest, said support means including a support member, a central pad on said support member for engagement by a patient's head, a plurality of additional pads positioned around said central pad so that each of said additional pads has an edge adjacent said central pad, hinge means connecting each of said edges of additional pads to said support member, a bladder on said support member beneath each of said additional pads, and means for selectively inflating said bladders for selectively pivoting said additional pads outwardly around said hinge means.

18. A device as recited in claim 17 in which there are four of said additional pads positioned at the top, bottom and side edges of said central pad, said hinge means extending along said top, bottom and side edges.

19. A device as recited in claim 18 in which said central pad is substantially square in plan form.

20. A device as recited in claim 18 in which said support member includes an outer surface, said outer surface including recesses beneath said additional pads, said bladders being positioned in said recesses.

21. A device as recited in claim 19 in which said edges of said additional pads are substantially straight.

22. A device for supporting a patient comprising seat means, backrest means extending from one end of said seat means and having an outer edge remote from said seat means, toeboard means extending from the opposite end of said seat means, a headrest on said backrest means beyond said outer edge thereof, said headrest including a support, a central pad, four additional pads, and means connecting said four additional pads to said support adjacent and around the periphery of said central pad so as to provide a top, a bottom, and two side pads for said headrest with the corners of said additional pads in adjacency, and inflatable means for varying the surface contour of said device, said inflatable means including a first transverse bladder on said backrest means adjacent said seat means, a second transverse bladder on said backrest means spaced from said first transverse bladder and adjacent said outer edge of said backrest means, a central bladder on said backrest means extending from adjacent said outer edge thereof to adjacent said first bladder, a bladder beneath each of said additional pads of said headrest for moving each of said additional pads outwardly upon inflation thereof, at least one transverse bladder on said toeboard means adjacent said seat means for providing the effect of a continuation of said seat means upon inflation thereof, a plurality of transverse bladders on said seat means extending inwardly from said end adjacent said toeboard means, and means for selectively inflating said bladders.

23. A device as recited in claim 22 including in addition means for lowering said backrest means, and an edge member adjacent either side edge of said backrest means, said edge members being movable outwardly relative to said side edges of said backrest means for providing support for the arms of a patient occupying said device when said backrest means is lowered.

24. A device as recited in claim 22 including means for raising said toeboard means, and an additional bladder on said toeboard means adjacent the outer end thereof and spaced from said first-mentioned bladder on said toeboard means, said additional bladder on said toeboard means being inflatable by said means for selectively inflating said bladders.

25. A device as recited in claim 24 including a second transverse bladder on said toeboard means adjacent said first-mentioned bladder on said toeboard means and spaced from said additional bladder on said toeboard means for further providing the effect of an extension of said seat means upon inflation thereof, said second bladder on said toeboard means being inflatable by said means for selectively inflating said bladders.

26. A device as recited in claim 22 in which said means connecting said additional pads to said support includes hinge means along the edges of said additional pads adjacent said central pad, so that said additional pads pivot about said hinge means when said additional pads are so moved outwardly.

* * * * *